US006395987B2

(12) United States Patent
Sinclair

(10) Patent No.: US 6,395,987 B2
(45) **Date of Patent: *May 28, 2002**

(54) FLEXIBLE ELECTRICAL CONDUCTOR

(76) Inventor: John Ashton Sinclair, Lot 1731, Combyne Road, Wingham, New South Wales 2429 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/817,157

(22) PCT Filed: Oct. 12, 1995

(86) PCT No.: PCT/AU95/00675

§ 371 (c)(1),
(2), (4) Date: Apr. 11, 1997

(87) PCT Pub. No.: WO96/12327

PCT Pub. Date: Apr. 25, 1997

(30) Foreign Application Priority Data

| | | |
|---|---|---|
| Oct. 14, 1994 | (AU) | PM8815 |
| Dec. 2, 1994 | (AU) | PM9833 |
| Jul. 20, 1995 | (AU) | PN4299 |

(51) Int. Cl.[7] ..... H01R 25/14
(52) U.S. Cl. ..... 174/84 C; 439/62; 439/111
(58) Field of Search ..... 174/84 C, 96, 174/97; 439/98, 877, 882, 110, 111, 112, 121, 62, 67

(56) References Cited

U.S. PATENT DOCUMENTS

| | | | | |
|---|---|---|---|---|
| 3,015,684 A | * | 1/1962 | Schneider | 174/84 C X |
| 3,137,925 A | * | 6/1964 | Wahl | 174/84 C X |
| 4,412,107 A | * | 10/1983 | Hillmann | 439/110 X |
| 4,493,516 A | * | 1/1985 | Attema | 439/111 |
| 4,845,601 A | * | 7/1989 | Podbury et al. | 439/110 X |
| 4,881,907 A | * | 11/1989 | Bergman et al. | 439/111 |
| 5,044,980 A | * | 9/1991 | Krumme et al. | 439/67 X |
| 5,399,094 A | | 3/1995 | Korth et al. | 439/110 |
| 5,496,182 A | * | 3/1996 | Yasumura | 439/62 |

FOREIGN PATENT DOCUMENTS

| | | |
|---|---|---|
| DE | 3030449 A1 | 3/1982 |
| GB | 1 508 788 | 4/1978 |
| GB | 1 597 415 | 9/1981 |
| NZ | 172324 | 8/1975 |
| NZ | 207995 | 3/1988 |
| WO | WO 87/01524 | 3/1987 |
| WO | WO 93/03517 | 2/1993 |
| WO | WO 93/19506 | 9/1993 |
| WO | WO 96/12327 | 4/1996 |

* cited by examiner

*Primary Examiner*—Chau N. Nguyen
(74) *Attorney, Agent, or Firm*—Frommer Lawrence & Haug LLP; William S. Frommer; Matthew K. Ryan

(57) ABSTRACT

A flexible electrically conductive track including an elongated flexible insulating member providing at least one longitudinally extending slot to receive an electric conductor. The conductor includes a pair of generally parallel co-extensive contact strips joined by a plurality of transverse ribs. The slots are closed by resiliently displaceable flanges which are displaced to provide access to the conductor.

8 Claims, 10 Drawing Sheets

FLEXIBLE ELECTRICAL CONDUCTOR

BACKGROUND OF INVENTION

The present invention relates to electricity supply apparatuses and more particularly relates to an electrical conductor for use with such apparatuses particularly flexible conductive tracks for use in walls, floors, skirting boards or ceilings.

PRIOR ART

In the past, flexible electric conductors have been known for use with electrical distribution systems and in particular, flexible conductive tracks.

One such conductor was disclosed in international application PCT/AU92/00414 wherein there is disclosed an insulating housing able to travel around curves and corners without the need to provide corner junctions or adaptors.

The known electrical distribution systems including flexible conductive tracks include a plurality of longitudinally extending recesses which close when the flexible conductive track is bent.

The flexible conductor disclosed in the above PCT application comprises solid copper wire supporting a conductive blade which has a series of cut outs along its length. It was found that this track did not perform to expectation in that it was not wholly conducive to bending and in fact sometimes resulted in damage to the conductive elements. An alterantive electrical conductor for use in a flexible conductive track was disclosed in a subsequent application by the same applicant as that for the above PCT international application. That application serial No. 24215/92 disclosed an elongated flexible conductor assembly located in a longitudinally extending slot in a housing for use in an electrical bus distributor. The conductor disclosed in that specification comprised of a coiled hollow conductor located in slots provided in the elongate flexible insulated housing. In order to effect engagement between the conductor and the electrical plug, pins on the plug were adapted with connector sockets formed by a bifurcated member which upon engagement with the continuous conducting element spread apart and engaged the conductor on either side. In use, it is predictable that the electrical contact between the connector sockets and the conductor will sometimes be compromised as the sockets after continued use begin to loose their elastic memory upon which reliance was placed to effect proper electrical connection.

A flexible electrically conductive track is discussed in Australian Patent 655069. The elongated flexible electric conductor consists of a length of conductive wire over which there is placed prongs or arms. A plug having one or more tines engages the conductor by having its tine located between the lugs or arms. A cover strip is employed to enclose the conductor, however it has to be removed to provide access to the conductor thereby making the strip prone to be lost.

The above discussed electric conductor has the disadvantage that it is made of several components requiring assembly. This adds to the cost of manufacture.

Still further, the conductor is located within insulating material which is then inserted in an extrusion. The extrusion provides a cavity for the conductor and insulating material and provides a slot through which a plug is inserted to engage the conductor.

A disadvantage of the above discussed arrangement is that dust and water can enter the extrusion.

SUMMARY OF THE INVENTION

There is disclosed herein an elongated flexible electric conductor of unitary construction, said conductor comprising:

two longitudinally extending edge strips which are transversely opposed so that a gap is defined therebetween; and a plurality of transverse rib elements extending between the strips, the elements being located at space locations along the conductor so that the elements are spaced, with the elements being resiliently deformable so that the strips are urged toward each other.

There is further disclosed herein an electric duct assembly comprising:

an elongated housing generally enclosing a longitudinally extending hollow and having a longitudinally extending slot to provide access to the hollow;

an elongated insulated electrical conductor mounted within the hollow and adapted to be engaged at a selected position along the housing by an electrical connector to receive electric power from the conductor; and displaceable cover means captively mounted with respect to the housing and closing said slot but displaceable therefrom to provide access to said connector.

There is still further disclosed herein an elongated insulating member for an electric conductor, said insulating member having longitudinally extending slot to receive the conductor, and at least resiliently deformable flange closing the slot but being displaceable to provide access to the conductor.

BRIEF DESCRIPTION OF THE DRAWINGS

Preferred forms of the present invention will now be described by way of example with reference to the accompanying drawings wherein.

DETAILED DESCRIPTION OF CERTAIN PREFERRED EMBODIMENTS

Figure 1:
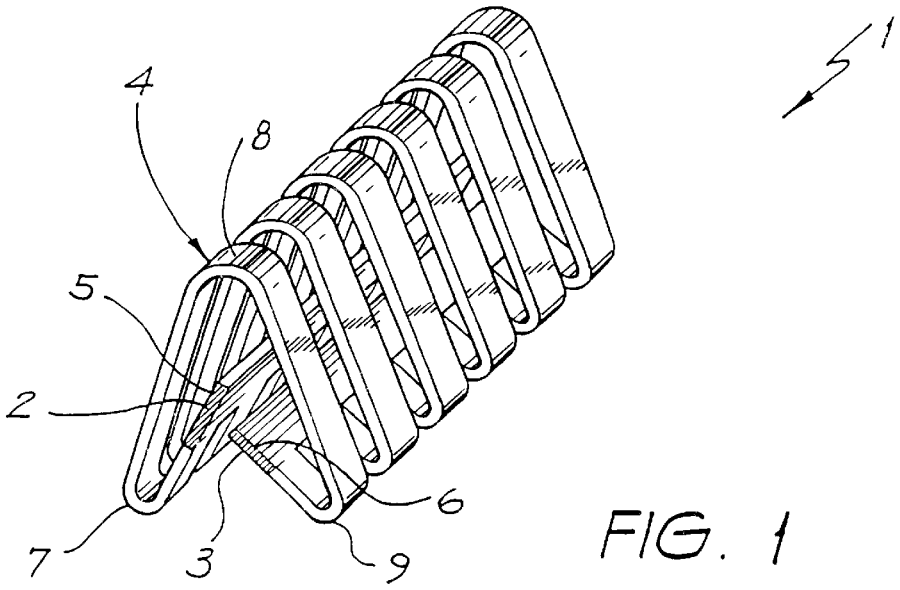
FIG. 1: shows a perspective view of a continuous conductor according to a preferred embodiment of the invention.

Referring to FIG. 1 there is shown a conducting system 1 according to a preferred embodiment of the invention. In this embodiment the conductor has two spines. Element 1 comprises continuous spines 2 and 3 to which there is attached secondary conductive ribs 4. Preferably, the secondary conductive rib 4 are each integral with spines 2 and 3. Each rib 4 has fixed ends 5 and 6 terminating at spines 2 and 3 respectively and include first, second and third bends 7, 8 and 9. By introducing the bends, end 5 terminates close to end 6 of rib 4 thereby forming a set of jaws which receive a pin (see FIG. 3) from an electric plug. The jaws displace when the pin is inserted therebetween ensuring that ends 5 and 6 are urged into continuous electrical contact with the pin. The return portions 12 are located adjacent the spines (edge strips) 2 and 3, with the return portions 12 being joined to the remaining portions of the ribs 4 by bends 7 and 9.

Figure 2:
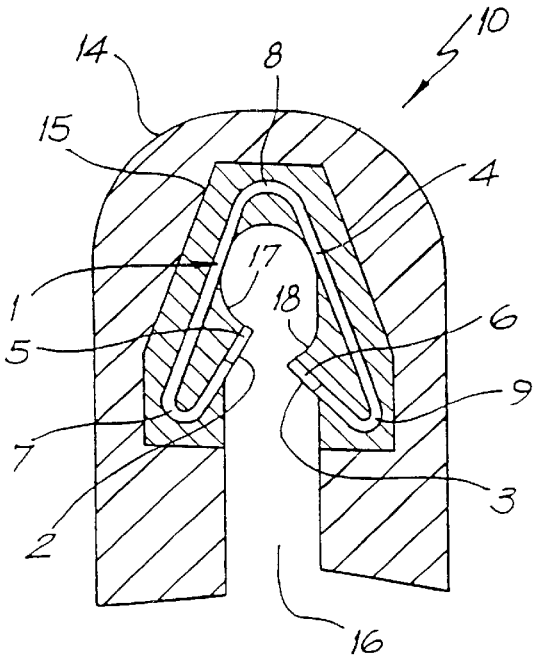
FIG. 2: shows a cross sectional view of the continuous conductor of FIG. 1 embedded in an insulating housing.

Referring to FIG. 2 there is shown a cross sectional view of the continuous electrical conductor of FIG. 1 embedded in a plastics housing 10. Conductor 1 comprises a series of ribs integral with spines 2 and 3. In FIG. 2 typical rib 4 comprises copper. Rib 4 is configured according to this embodiment by cold bending such that a series of bends 7, 8 and 9 are introduced so that end 5 locates close to end 6 thereby forming the jaws within which pin 19 (see FIG. 3) penetrates to establish an electrical connection. Housing 10 comprises outer casing 14 and inner core 15. Outer casing 14 is formed from a flexible but firm plastics material, whereas inner core 15 comprises a softer and more flexible plastics material. According to this embodiment, rib 4 is almost completely embedded in inner core 15 save for ends 5 and 6 which must be outside the housing 10 to enable electrical contact between pin 19 inserted therein (see FIG. 3) and ends 5 and 6. Housing 10 includes a passage 16 into which pin 19 penetrates to establish electrical contact with ends 5 and 6.

FIG. 2 shows the configuration of the rib 4 and contour of inner core 15 prior to insertion of the pin 19 to establish electrical contact. Before insertion of the pin, ends 5 and 6 are almost perpendicular to each other, and are maintained in that attitude by protrusions 17 and 18 of inner core 15. Although protrusions 17 and 18 provide some resistance for ends 5 and 6, ends 5 and 6 rely primarily on the resilience in the flexible copper material to be restored to the rest configuration when pin 19 is released. When the pin is inserted then released, the elastic memory in the copper conductor performs a crucial role in preserving the integrity of the electrical contact. The movement of the copper is so minimal when the pin is inserted that it retains its elastic memory.

Figure 3:
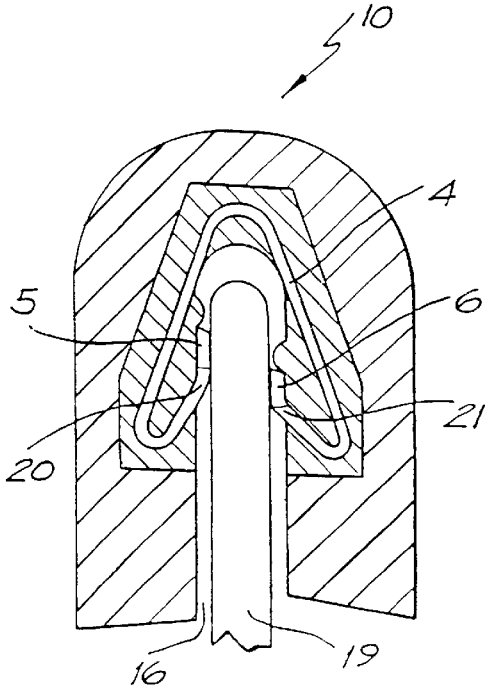
FIG. 3: shows the conductor of FIG. 2 with a pin of an electrical plus inserted therein.

Referring to FIG. 3 there is shown a cross sectional view of a the conductive rib 4 of FIG. 2 this time with pin 19 of an electrical plug inserted therein. Conductive rib 4 is shown embedded in insulating housing 10 as described for FIG. 2. When pin 19 is inserted between ends 5 and 6, ends 5 and 6 are urged against pin 19 due to the natural bias towards the pin created by bends 20 and 21, and/or upper apex respectively thereby ensuring continuous electrical contact between pin 19 and ends 5 and 6 respectively.

Figure 4:
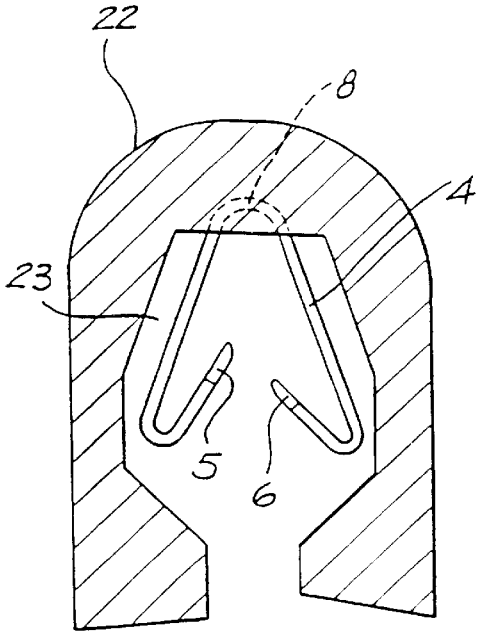
FIG. 4: shows another cross sectional view of the continuous conductor wherein a portion only of the conductor is embedded in an insulating housing.

Referring to FIG. 4 there is shown the rib 4, this time only partially inserted in an alternative housing 22. According to this embodiment housing 22 does not include an inner core analogous to inner core 15 shown in FIGS. 2 and 3. Rather, rib 4 is disposed in clear passage 23 with only bend 8 embedded in the plastics material of housing 22. According to this embodiment the integrity of the electrical connection between ends 5 and 6 is reliant on the elastic memory in the copper and hence the resilience of the copper material.

Figure 5:
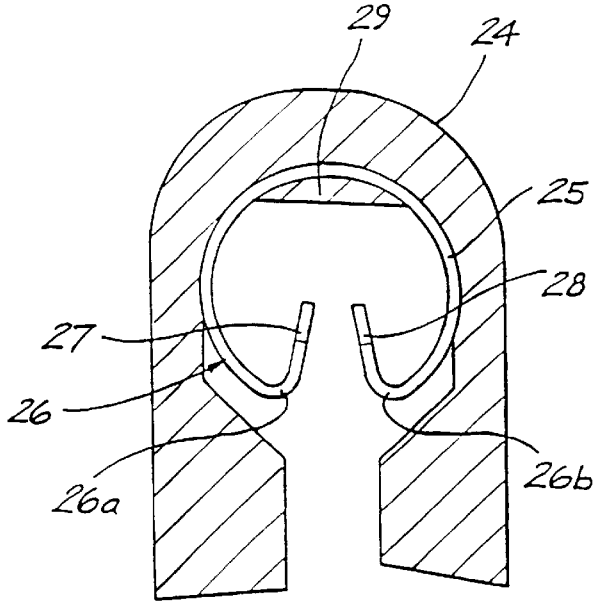
FIG. 5: shows a cross sectional view of a conductor having an alternative configuration embedded in an insulating housing.

Referring to FIG. 5 there is shown an alterative configuration of rib and housing. According to this embodiment, housing 24 includes rib 25 which includes a substantially circular body 26 which terminates at spines 27 and 28. As with the rib 4 in FIG. 4, rib 25 is only partially embedded in housing 24 via sector 29. Electrical connection between a pin (not shown) and spines 27 and 28 is effected in a similar manner as that described with reference to FIG. 3. The grooves 27*a* (see FIG. 7) separated returns 26*a* and 26*b* of body 26 otherwise flexibility of the continuous conductor will be compromised. Similarly for the ribs of FIGS. 1–4. The grooves extend around and past the return 26*a* and *b*, if not flexibility will be compromised.

Figure 6:
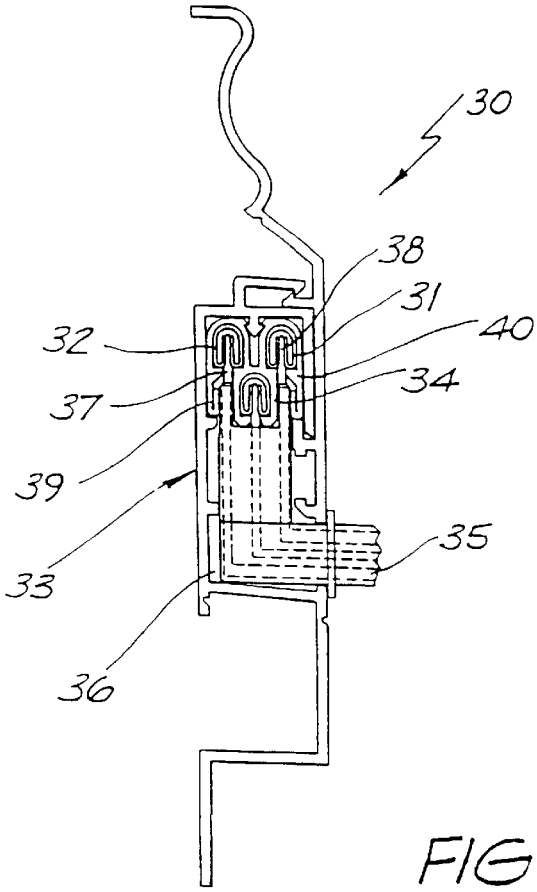
FIG. 6: shows a cross section of a flexible electrical duct showing typical engagement between the pin of an electrical plug and a continuous conductor according to one embodiment of the invention.

FIG. 6 shows a cross sectional view of a typical flexible skirting duct assembly 30 incorporating continuous electrical conductors 31 and 32. Typically, dust housing 33 is mounted on a wall surface where power is required. Housing 33 includes plastic housing 34 which receives and supports conductors 31 and 32. The arrangement shown in FIG. 6 incorporates the conductor and housing arrangement of FIG. 5 previously described. When electrical contact is to be made between the electrical plug 35 and continuous conductors 31 and 32 plug 35 is advanced towards opening 36 so that pins 37 and 38 are able to penetrate the opening. This can only be achieved when plug 35 is rotated so that pins 37 and 38 are parallel to the longitudinal axis of opening 36.

When the plug is inserted and once pins 37 and 38 are an alignment with openings 39 and 40 respectively, plug 35 is then rotated to enable pins 37 and 38 to engage conductors 31 and 32 according to the manner previously described.

Conductors 31 and 32 are configured so as to allow bending where the duct, for instance, is required to travel around corners and curved surfaces and also to enable tight interfitting between pins 37 and 38 and the conductor thereby ensuring the integrity of the electrical connection.

Due to the separation between the conducting ribs, the duct in which the electrical conductor is located is able to be freely bent without risking breaking electrical contact between pin and the jaws of each rib. In the circumstance where heat is induced in the connection electrical contact is not dependent upon the insulating material of the housing to ensure electrical connection between the jaws. If the electrical connection relies on the integrity of the insulating material for contact and heat affects the insulating material electrical contact can vary often be affected. According to the present invention the jaws of the conducting elements are sufficiently biased towards the pin 19 to ensure that electrical contact is independent of the integrity of the insulating material.

Figure 7:
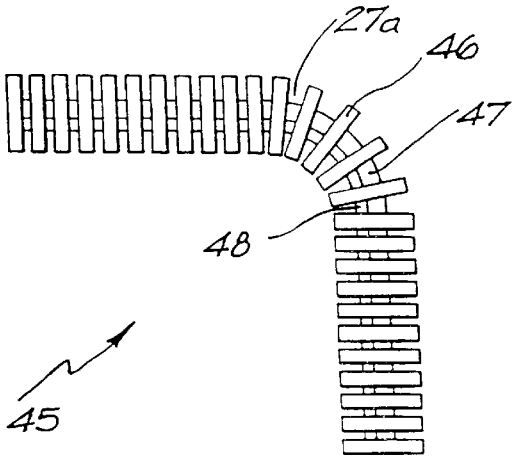
FIG. 7: shows a plan view of a continuous flexible conductor showing a series of ribs according to a preferred embodiment.

FIG. 7 shows a plan view of a flexible electrical conductor 45 according to a preferred embodiment. Conductor 45 includes a series of spaced apart ribs 46 which are integral with spines 47 and 48.

According to an alternative embodiment of the invention there is provided a flexible electrical conductor comprising a rib and spine arrangement manufactured from a non-conductive material wherein the spine is contoured to receive a conductive element such as a copper wire or strip as a transporter of electrical current. Preferably, the non-conductive material is phosphorous bronze which has sufficient flexibility and durability. Thus, the manufacture of the spine and rib arrangement from a flexible material satisfies the flexibility requirement but may not satisfy the conductivity requirements. The latter is provided by the introduction of the copper strip or wire. The electric plug which is inserted into the spine makes contact with the copper wire to effect electrical connection. This arrangement can result in both reduced material costs and electrical resistance.

Figure 8:
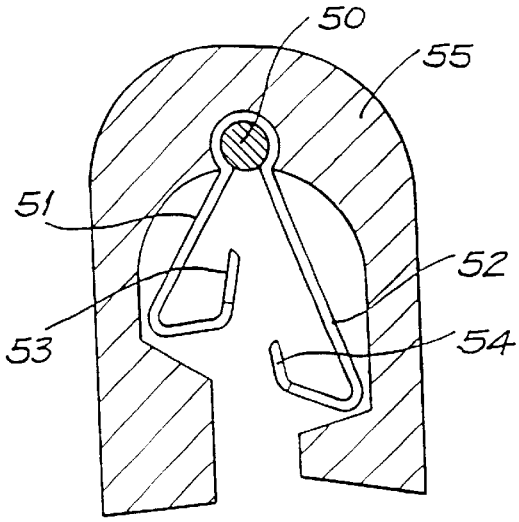
FIG. 8: shows a cross sectional view of a flexible conductor according to an alternative embodiment of the invention.

Referring to FIG. 8 there is shown a cross sectional view of a flexible conductor according to an alternative embodiment of the invention. The flexible conductor comprises a spine 50 comprising ribs 51 and 52 which may be of equal or unequal length and which terminate in free ends 53 and 54 respectively. In FIG. 8 the ribs 51 and 52 are shown as having unequal length. One advantage of the ribs having unequal length is that the spines may passe each other when the flexible conductor is bent to travel around a corner (see FIGS. 9*a* and *b* below). The embodiment of spine 50 of FIG. 8 is shown partially embedded in flexible PVC mould 55.

Figure 9A:
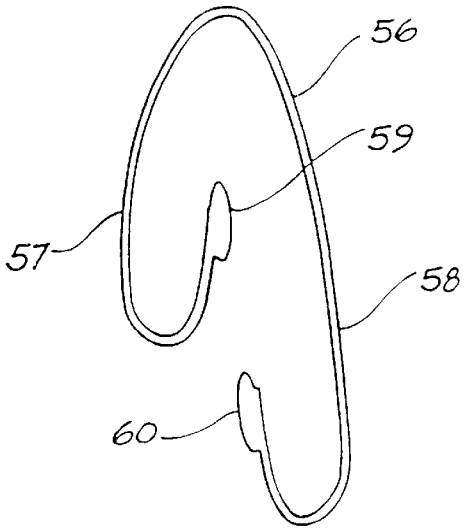
FIGS. 9*a,* 9*b:* show the ribs of a typical spine of the flexible electrical conductor of FIG. 8 in the folded and unfolded configurations.
Figure 9B:
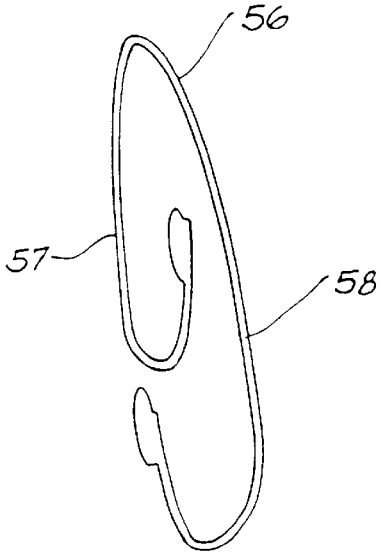

Referring to FIGS. 9*a* and *b* there is shown a typical spine 56 in isolation from the plastics mould. FIG. 9*a* shows ribs 57 and 58 as they would normally be disposed. FIG. 9*b* shows rib 57 urged substantially into alignment with rib 58. This occurs when the flexible conductor is bent around a corner and reduces the space taken by the ribs resulting in slimming at bends and corners. At the end of each of ribs 57 and 58 are copper conductors 59 and 60 which contact a conducting pin of an electrical plug inserted into the flexible conductor.

Figure 10:
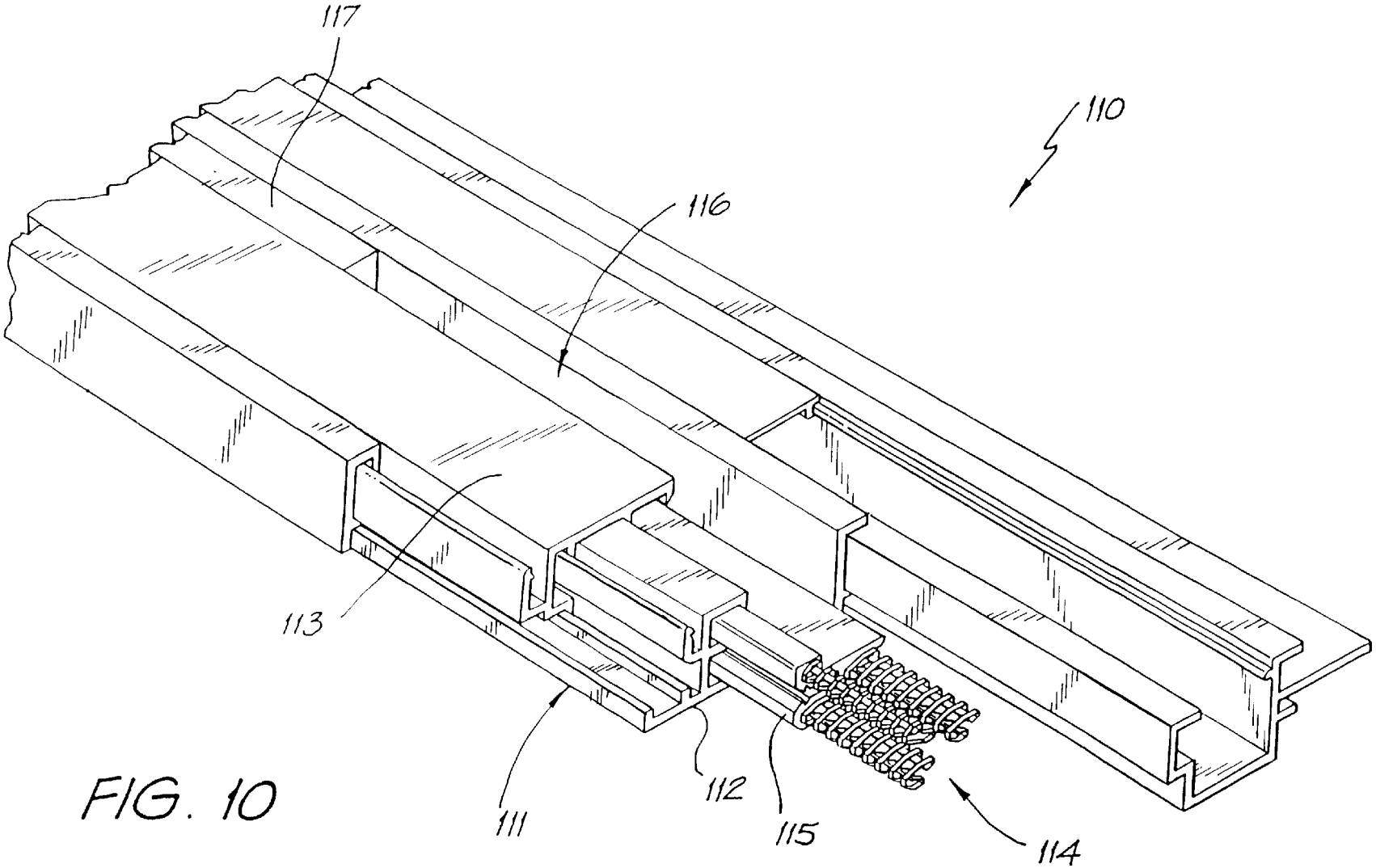
FIG. 10 is a schematic perspective view of an electric duct.
Figure 12:
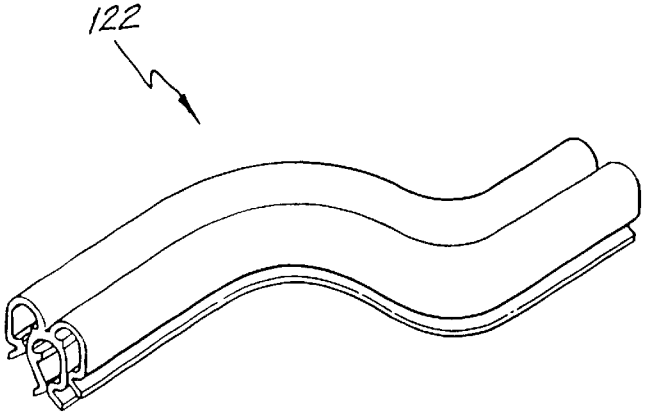
FIG. 12 is a schematic perspective view of a length of insulating material employed in the duct of FIG. 10.

In FIG. 10 there is schematically depicted an electric duct 110 which includes an elongated housing 111 consisting of two sections 112 and 113. The elongated sections 112 and 113 could be, for example, aluminium or plastics extrusions. The sections 111 and 112 cooperate to enclose a hollow within which there is located three elongated flexible electric conductors 114 located within an elongated flexible insulating member 115.

The sections 112 and 113 cooperate to define a slot 16 which is closed by a cover member 117.

Figure 13:
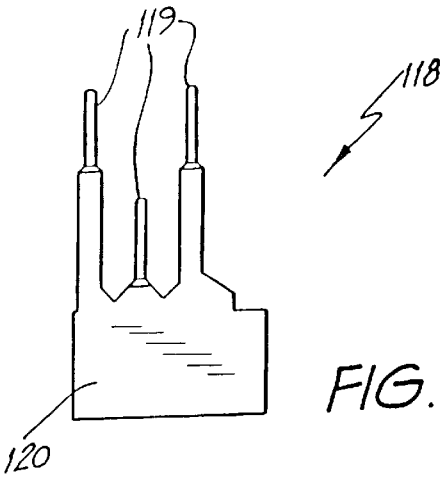
FIG. 13 is a schematic side elevation of a connector which may be used with the duct of FIG. 10.

In use of the above described duct 110, the duct 110 is used in conjunction with a plug or connector 118 (FIG. 13) which includes three tines 119 each adapted to selectively engage a respective one of the conductors 114. The connector 118 has a base 120 which is inserted through the slot 116 whereafter the connector 118 is rotated bringing the tines 119 into contact with the conductors 114.

The cover member 117 for example may be formed of expanded foam material and may be transversely slotted or grooved.

When the connector 118 is inserted through the slot 116, the member 117 is resiliently deformed to provide access to the conductor 114. When the connector 118 is removed, the member 117 resumes its position closing the slot 116.

Figure 11:
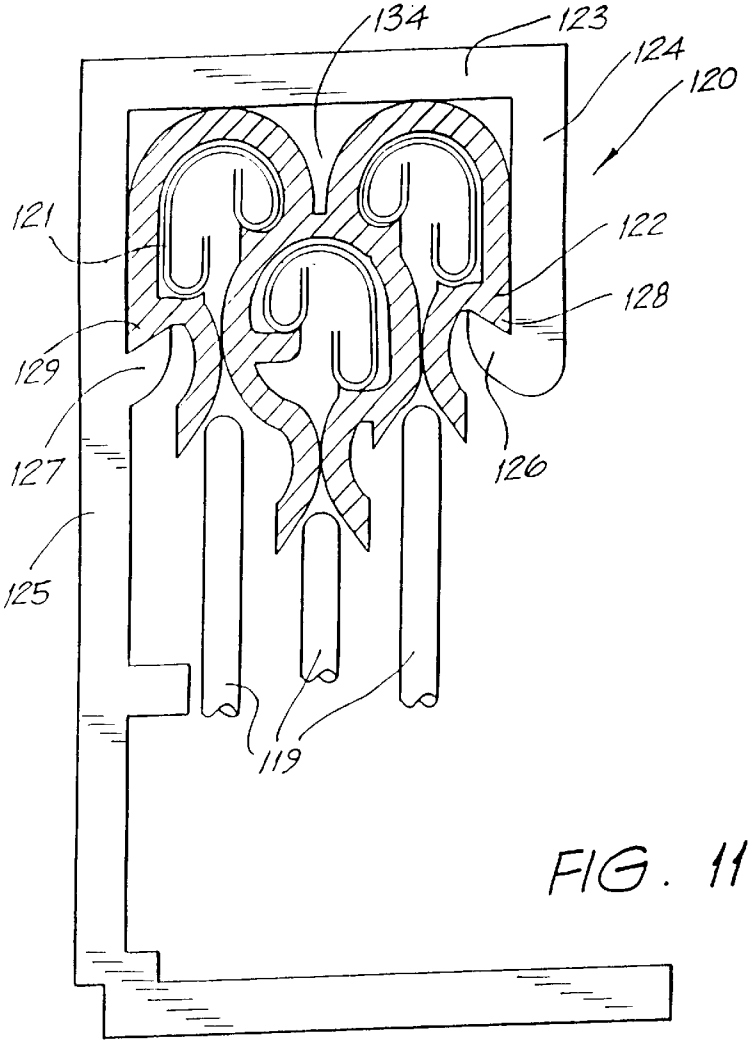
FIG. 11 is a schematic part sectioned end elevational view of an alternative extrusion to receive conducting members located within an insulating member.

In FIG. 11 there is schematically depicted an alternative extrusion 120 to receive three conductors 121 located within an elongated insulating member 122.

The extrusion 120 has a longitudinally extending end wall 123 from which there extends two longitudinally extending flanges 124 and 125. The flange 124 terminates with a longitudinally extending barb 126 while the flange 125 has a longitudinally extending barb 127.

The insulating member 122 has longitudinally extending ridges 128 and 129 which cooperate with the barbs 126 and 127 to retain the insulating member 122 and therefore the conductors 121 in position.

The end wall 123 is also provided with a longitudinally extending ridge 130 which extends into a longitudinally extending valley formed in the insulating member 122.

The conductors 121 and insulating member 122 are flexible.

Figure 21:
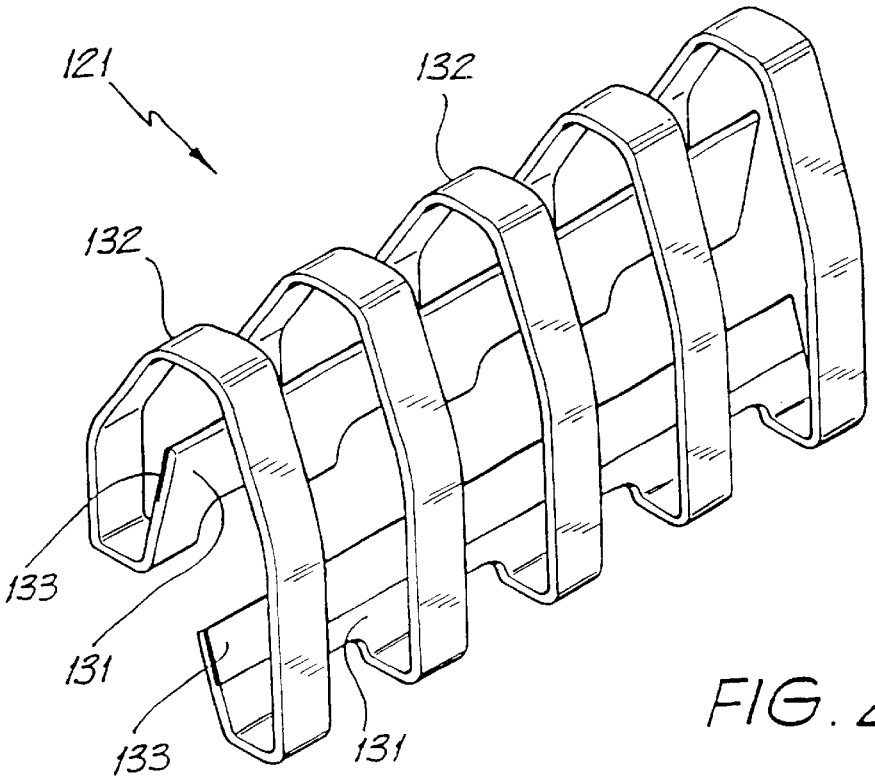
FIG. 21 is a schematic perspective view of the conductor of FIG. 14.
Figure 22:
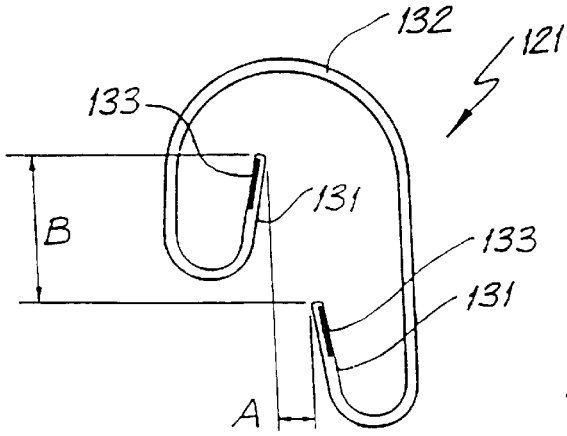
FIG. 22 is a schematic end elevation of the conductor of FIG. 21.
Figure 23:
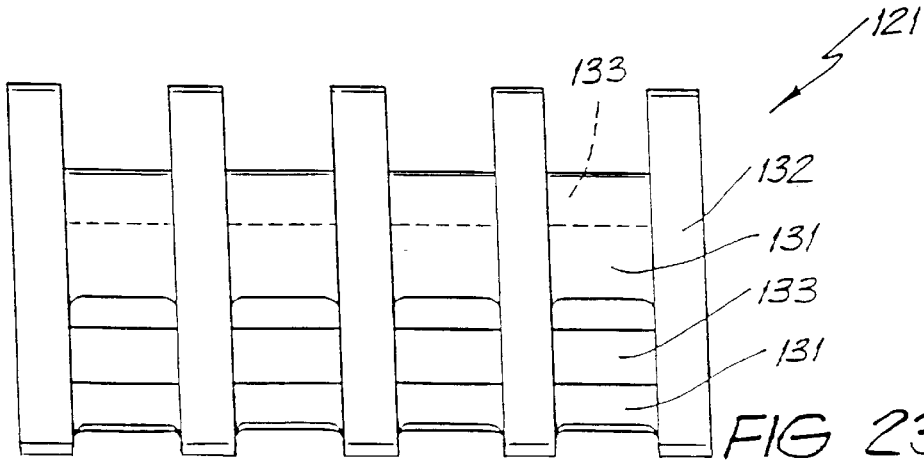
FIG. 23 is a schematic side elevation of the conductor of FIG. 21.

As best seen in FIGS. 21 to 23, the conductors each include two longitudinally extending edge strips 131 joined by transverse elements 132, with the elements 132 being located at spaced locations along the conductor 121. The conductors 121 are basically formed of phosphorus bronze so as to be resilient while there is further provided copper strips 133 extending along the strips 131. The strips 131 provide longitudinally extending spines.

As best seen in FIG. 22, the strips are spaced first in a first direction by the distance "A" and then by a second distance "B", which distances are perpendicular and transverse the longitudinal direction of extension of the conductor 121.

Figure 14:
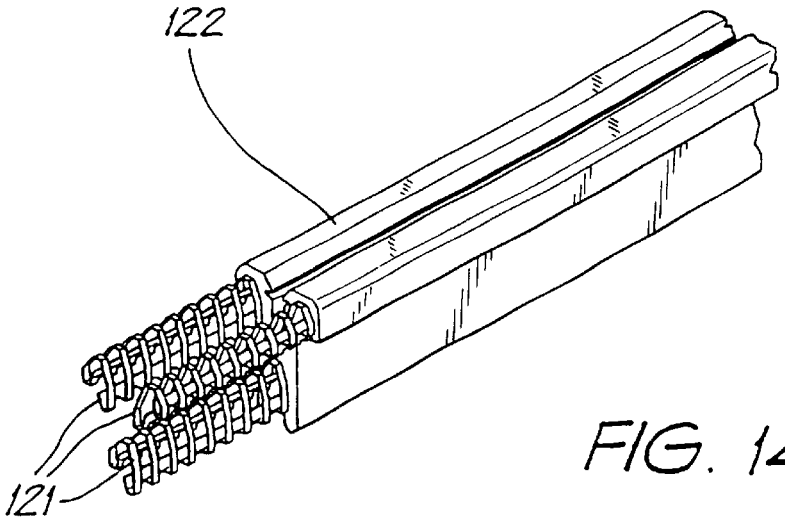
FIG. 14 is a schematic perspective view of an elongated flexible electric conductor and a surrounding insulation.
Figure 15:
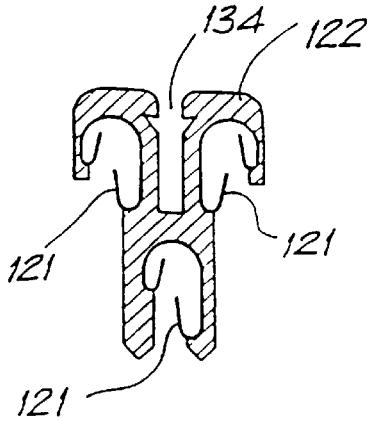
FIG. 15 is a schematic sectioned end elevation of the conductor and insulating material of FIG. 12.

In FIGS. 14 and 15 there is schematically depicted an alternative configuration of the insulating member 132. In this particular embodiment the insulating member 132 has a central longitudinally extending slot 134 which would cooperate with a correspondingly shaped barb located on a wall of a surrounding extrusion.

Figure 16:
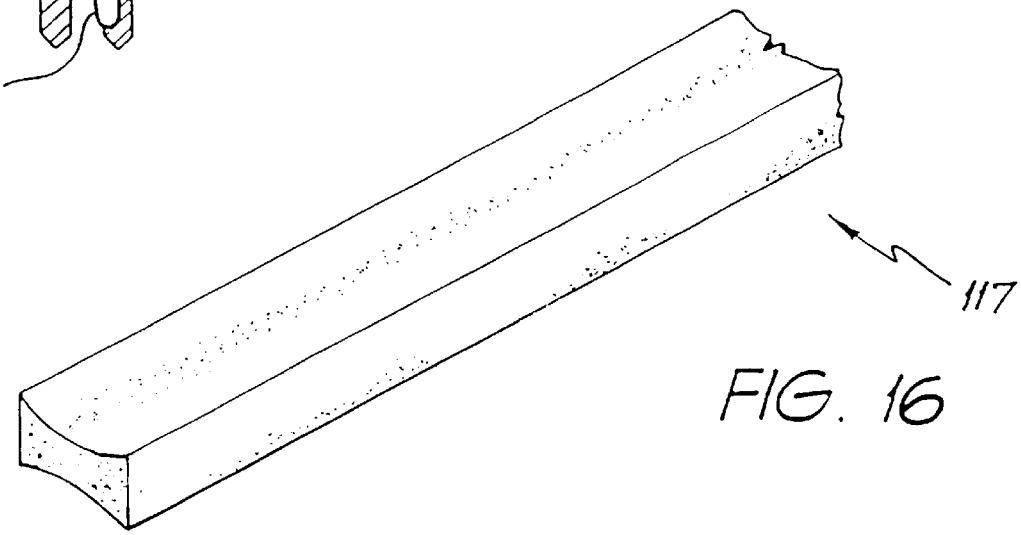
FIG. 16 is a schematic perspective view of a cover strip employed in the duct of FIG. 10.
Figure 17:
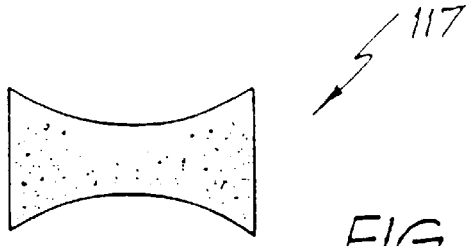
FIG. 17 is a schematic end elevation of the cover of FIG. 16.
Figure 18:
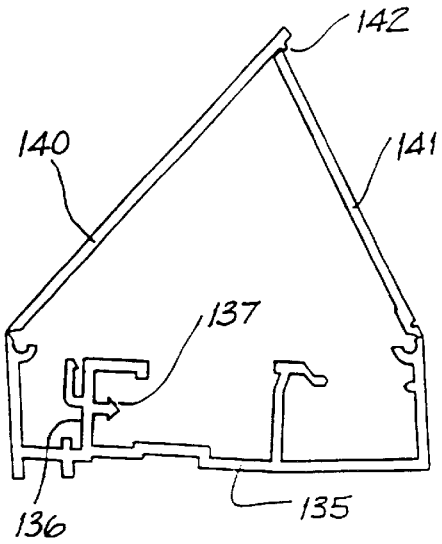
FIG. 18 is a schematic end elevation of a duct housing adapted to receive the conductor and insulating material of FIG. 14.
Figure 19:
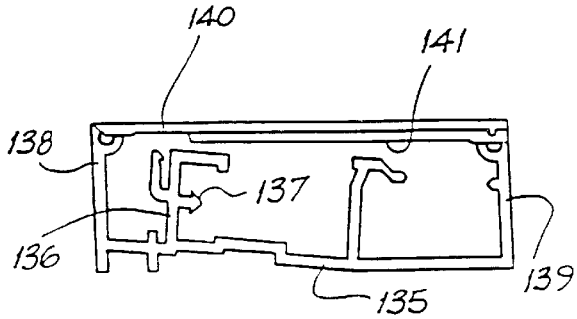
FIG. 19 is a schematic end elevation of the duct of FIG. 18.
Figure 20:
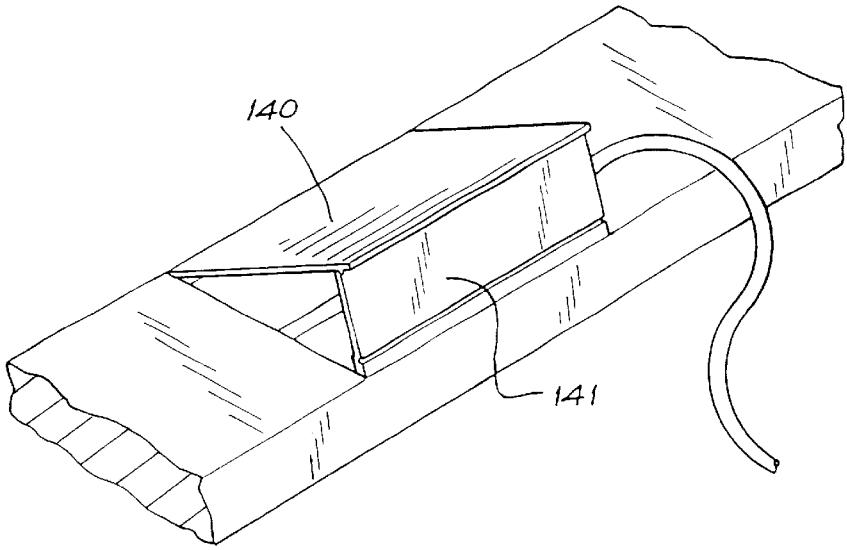
FIG. 20 is a schematic perspective view of the duct of FIG. 18.

For example, the insulating member 132 and conductors 121 as shown in FIGS. 14 and 15 may be incorporated in an extrusion 135 as shown in FIGS. 18 and 19. The extrusion 135 has a wall 136 from which there extends a barb 137 to engage within the slot 134. In this embodiment, the extrusion 135 has a pair of spaced end walls 138 and 139 between which there extends closure members 140 and 141. Both members 140 and 141 would be pivotally attached to an associated one of the walls 138 and 139 and would be movable to the position depicted in FIG. 16 from the position depicted in FIG. 19. A lip 142 would aid in retaining them in the position depicted in FIG. 18. The closure members 140 and 141 would be provided in segments to permit a portion of the extrusion 135 to be exposed to provide access for a connector to engage the conductors 121. In this embodiment the extrusion 134 is adapted to be incorporated in a floor, such as a computer floor.

Figure 24:
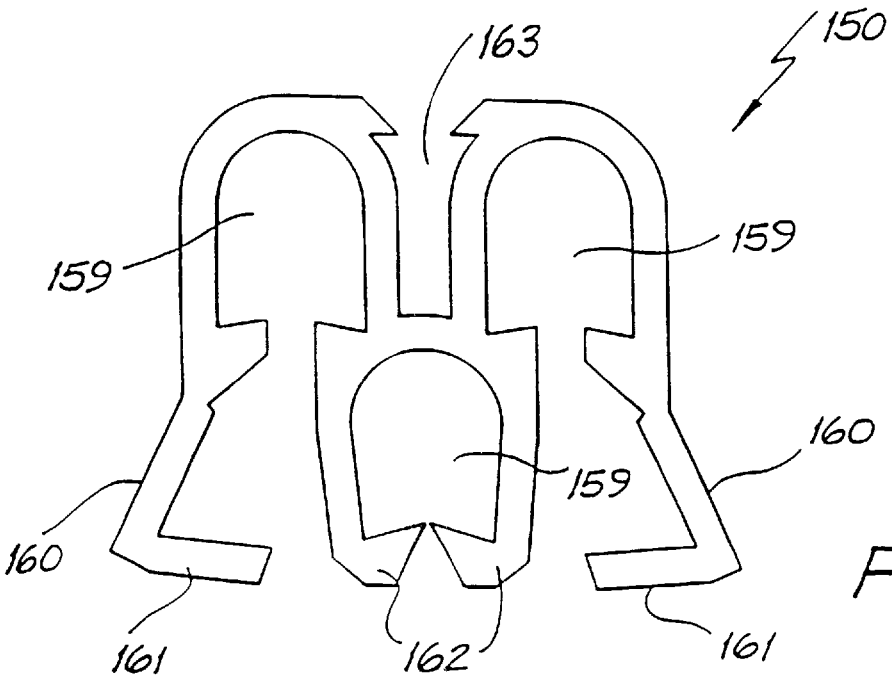
FIG. 24 is a schematic end elevation of a further insulating member.

In FIG. 24, there is schematically depicted an elongated insulating member 150, formed of flexible plastics material. Typically, the insulating member 150 would be extruded. The insulated member 150 is intended for inclusion in an elongated support 151 which may be an aluminium or plastics extrusion or similar type extrusion. The support 151 has an "L-shape" flange 152 including a first flange portion 153 extending generally normal to the base 154. Depending from the portion 153 is a further portion 155. The portions 153 and 155 co-operate with the base 154 to define an elongated slot 156 within which the insulating member 150 is located and held. The base 154 has a longitudinally extending rib 157 which inhibits removal of the insulating member 150 from within the slot 156.

Figure 26:
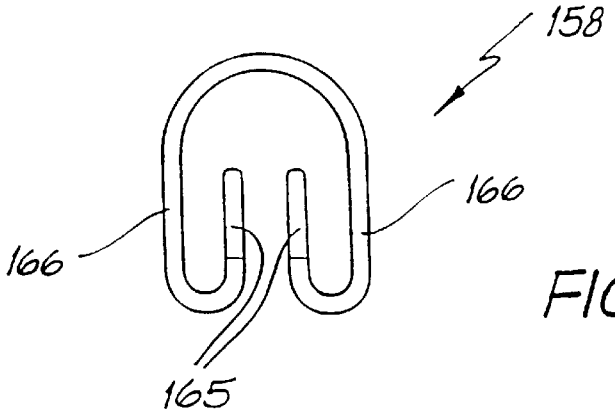
FIG. 26 is a schematic end elevation of an electric conductor employed in FIG. 25.
Figure 27:
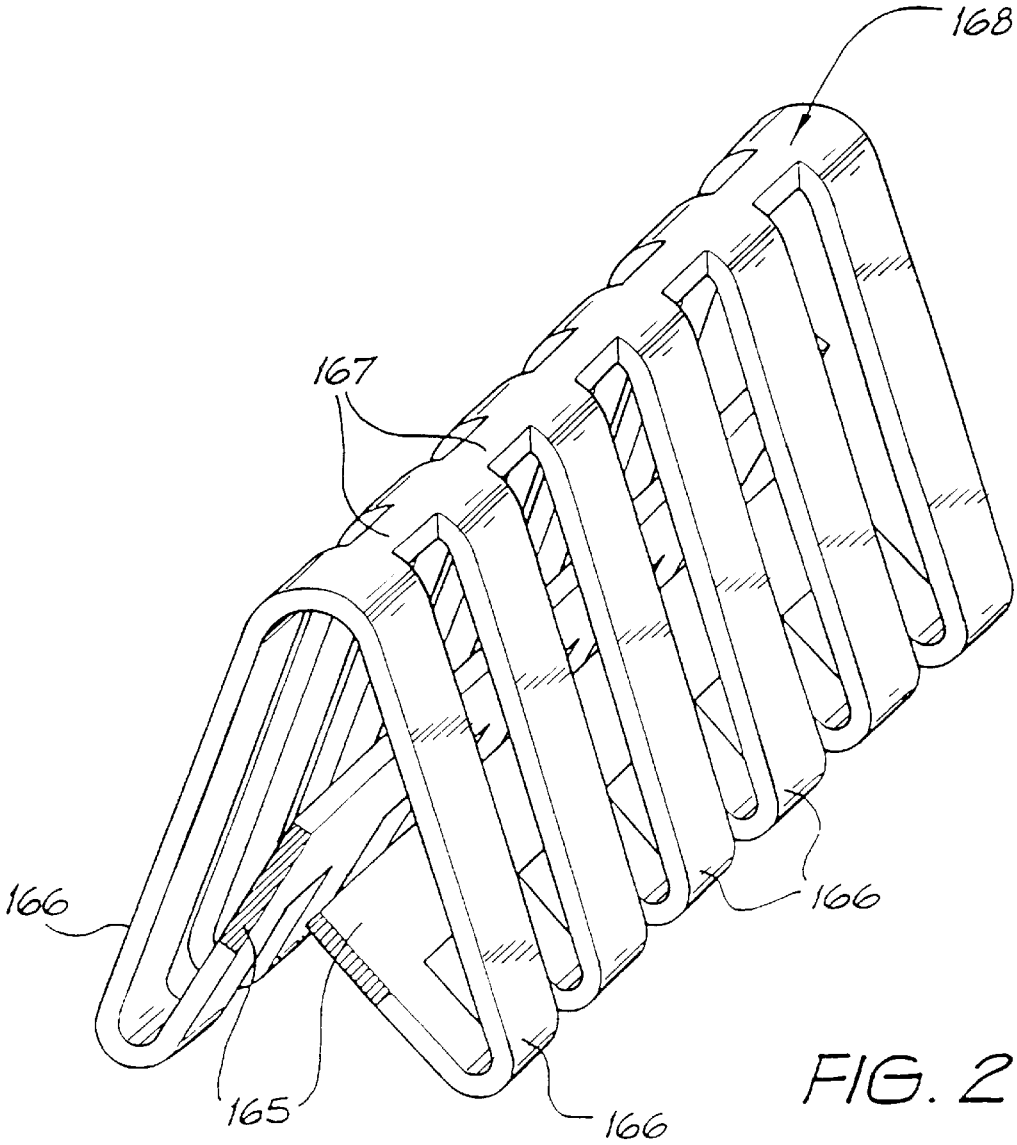
FIG. 27 is a schematic perspective view of a further electric conductor.

The insulating member 150 received three elongated conductors 158 (FIG. 26). The insulating member 150 has three longitudinally extending slots 159 shaped to receive the conductors 158. The insulating member 150 also has a pair of displaceable legs 160 which are displaced toward each other when they are located within the slot 156. Each of the legs 160 has an end longitudinally extending flange 161 which closes off the associated slot 159. Similarly, the central slot 159 is closed off by a pair of longitudinally extending flanges 162.

The flanges 161 and 162 are displaceable when engaged by a plug so that the plug can engage the conductors 158.

The insulating member 150 also has a central slot 156 shaped to engage the longitudinally extending barb 164 of the support 151 to further aid in retaining the insulating member 150 in position within the slot 156.

Figure 25:
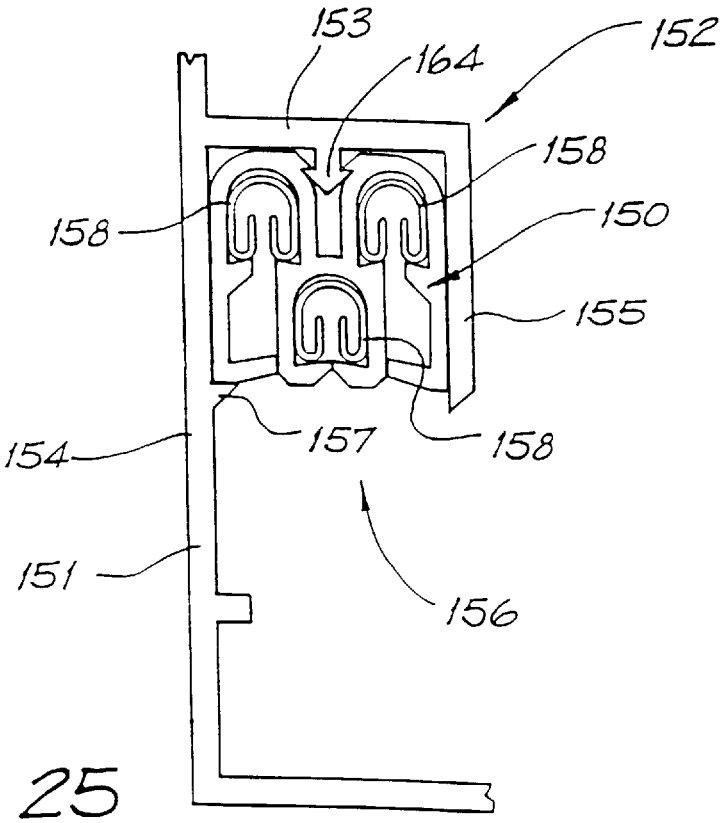
FIG. 25 is a schematic end elevation of the insulating member of FIG. 24, inserted in an elongated supporting housing.

Each conductor 158 is of an inverted "U-shaped" configuration. Typically, the insulating member 158 would be of a similar construction to the insulating members of FIGS. 25 and 26 in that it would have a longitudinally extending contact portions 165 joining a plurality of ribs or legs 166. A further longitudinal join could be provided by means of a longitudinally extending spine 167.

The additional spine 167 is provided for extra current should it be required. Also, by being adjacent the apex 168 of each of the legs or ribs of 166, there is no reduction in flexibility of the conductor 158 about a transverse axis. In FIG. 26, the conductor 158 has the longitudinally extending contact portions 165 generally parallel and co-extensive.

It will be recognised by persons skilled in the art that numerous variations and modifications can be made to the invention without departing from the overall spirit and scope of the invention as broadly described herein.

What is claimed is:

1. A flexible electrical conductor assembly including:

a flexible elongated insulating member providing at least one longitudinally extending insulator slot;

an elongated flexible electric conductor of unitary construction, the conductor having two longitudinally extending edge strips which are transversely opposed, and a plurality of transverse rib elements extending between the strips, the elements being located at spaced locations along the conductors so that the elements are spaced, with the elements being deformable so that upon transverse separating displacement of the strips, the strips are urged toward each other, said rib elements each including a first bend from which the element diverges to return portions adjacent said edge strips, which return portions are joined to remaining portions of said rib elements by bends, the bends of adjacent rib elements being separated by slots, the return portion projecting generally back toward said first bend; and wherein said conductor is located in said insulator slot so that a plug member entering said insulator slot would be located between said strips so as to be in electrical contact therewith.

2. The flexible electric conductor assembly of claim 1, wherein said rib elements are of a "U-shaped" configuration with each of said rib elements providing a pair of extremities at said return portions, with the strips joining the extremities.

3. The flexible electric conductor assembly of claim 1, wherein the strips provide generally parallel contact surfaces.

4. The flexible electric conductor assembly of claim 1, further including resilient deformable means closing the insulator slot and which is displaced to provide access to the conductor.

5. The flexible electric conductor assembly of claim 1, wherein said rib elements are of a substantially circular configuration with each rib element providing a pair of extremities at said return portions, with the strips joining the extremities.

6. The flexible electrical conductor assembly of claim 1 wherein the first bends are joined by a spine.

7. The flexible electric conductor assembly of claim 6, wherein said spine is formed integrally with said first bends.

8. The flexible electric conductor assembly of claim 1, wherein said longitudinal edge strips are opposed so that a gap is defined therebetween.

* * * * *